US009951604B2

(12) United States Patent
Hay

(10) Patent No.: US 9,951,604 B2
(45) Date of Patent: Apr. 24, 2018

(54) SYSTEMS AND METHODS FOR OPTIMIZING GRADIENT MEASUREMENTS IN RANGING OPERATIONS

(71) Applicant: Halliburton Energy Services, Inc., Houston, TX (US)

(72) Inventor: Richard Thomas Hay, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 304 days.

(21) Appl. No.: 14/768,163

(22) PCT Filed: Mar. 18, 2013

(86) PCT No.: PCT/US2013/032813

§ 371 (c)(1),
(2) Date: Aug. 14, 2015

(87) PCT Pub. No.: WO2014/149030

PCT Pub. Date: Sep. 25, 2014

(65) Prior Publication Data

US 2016/0003029 A1 Jan. 7, 2016

(51) Int. Cl.

| | |
|---|---|
| ***E21B 47/022*** | (2012.01) |
| ***E21B 17/00*** | (2006.01) |
| ***E21B 47/01*** | (2012.01) |

(52) U.S. Cl.

CPC ..... *E21B 47/02216* (2013.01); *E21B 17/00* (2013.01); *E21B 47/01* (2013.01); *E21B 47/022* (2013.01)

(58) Field of Classification Search

None

See application file for complete search history.

(56) References Cited

U.S. PATENT DOCUMENTS

| | | | |
|---|---|---|---|
| 4,072,200 | A | 2/1978 | Morris et al. |
| 4,933,640 | A | 6/1990 | Kuckes |

(Continued)

FOREIGN PATENT DOCUMENTS

| | | | |
|---|---|---|---|
| CN | 1580488 | A | 2/2005 |
| CN | 102272633 | A | 12/2011 |

(Continued)

OTHER PUBLICATIONS

"Rotary Shoulder Handbook", Nov. 1, 2011 (Nov. 1, 2011), pp. 1-116, XP055097517, Retrieved from the Internet <URL:http://www.nov.com/uploadedFiles/Business_Groups/Grant_Prideco/Drilling_Tubulars/Catalog/D392002466-MKT-001 Rev 02 Rotary Shoulder Handbook RS.pdf>.

(Continued)

*Primary Examiner* — Khaja Ahmad

(74) *Attorney, Agent, or Firm* — John W. Wustenberg; Baker Botts L.L.P.

(57) ABSTRACT

The system comprises a drilling apparatus comprising a first portion (111) and a second portion (116). In certain embodiments, the first portion may comprise a bottom hole assembly (BHA) or a drill string, and the second portion may comprise a sensor extension housing. The first portion (111) has a first diameter and the second portion (116) has a second diameter that is greater than the first diameter. The system includes a sensor pair 114) disposed within the second portion and proximate to an outer radial surface of the second portion. A processor is in communication with the sensor pair. The processor determines at least one gradient measurement based, at least in part, on outputs of the sensor pair.

18 Claims, 8 Drawing Sheets

(56) References Cited

U.S. PATENT DOCUMENTS

| | | | | |
|---|---|---|---|---|
| 5,200,705 | A | 4/1993 | Clark et al. | |
| 5,235,285 | A | 8/1993 | Clark et al. | |
| 5,305,212 | A | 4/1994 | Kuckes | |
| 5,339,036 | A | 8/1994 | Clark et al. | |
| 5,343,152 | A | 8/1994 | Kuckes | |
| 6,986,282 | B2 | 1/2006 | Ciglenec et al. | |
| 7,345,487 | B2 | 3/2008 | Bittar et al. | |
| 7,557,582 | B2 | 7/2009 | Moore et al. | |
| 8,011,451 | B2 | 9/2011 | MacDonald | |
| 8,113,298 | B2 | 2/2012 | Kuckes | |
| 2009/0164127 | A1 | 6/2009 | Clark et al. | |
| 2009/0166035 | A1* | 7/2009 | Almaguer | E21B 7/061 166/254.1 |
| 2011/0109470 | A1* | 5/2011 | Clark | E21B 47/022 340/856.3 |
| 2011/0226531 | A1* | 9/2011 | Jones | E21B 47/082 175/50 |
| 2011/0308859 | A1 | 12/2011 | Bittar et al. | |
| 2012/0013339 | A1* | 1/2012 | Kuckes | E21B 47/02216 324/346 |
| 2012/0145463 | A1* | 6/2012 | Lee | E21B 43/305 175/79 |
| 2012/0199400 | A1 | 8/2012 | Boulet et al. | |
| 2012/0201659 | A1* | 8/2012 | Savage | F04D 13/10 415/143 |
| 2012/0222900 | A1* | 9/2012 | Rodney | E21B 44/00 175/56 |
| 2013/0069655 | A1* | 3/2013 | McElhinney | G01V 3/26 324/346 |

FOREIGN PATENT DOCUMENTS

| | | | |
|---|---|---|---|
| RU | 2319005 | C2 | 3/2008 |
| RU | 2439319 | C2 | 1/2012 |
| SU | 275926 | C2 | 7/1970 |
| WO | 2007143384 | A2 | 12/2007 |
| WO | 2011146889 | A1 | 11/2011 |

OTHER PUBLICATIONS

Office Action issued in related EP Application No. 13716095.8, dated Mar. 29, 2017 (5 pages).

International Search Report and Written Opinion issued in related PCT Application No. PCT/US2013/032813, dated Nov. 26, 2013 (12 pages).

Second Written Opinion issued in related PCT Application No. PCT/US2013/032813, dated Apr. 14, 2015 (6 pages).

Norman J. Hyne: "Dictionary of Petroleum Exploration, Drilling and Production", Jan. 1, 1990 (Jan. 1, 1990), PennWell Books, Tulsa, Oklahoma, USA XP055181401, ISBN:978-0-87-814352-8, p. 155.

Office Action issued in related Russian Application No. 2015134588, dated Nov. 8, 2016 (15 pages).

Konnov, V.V. "Some Questions of Optimizing the Magnetometric Method of Controlling the Stressed-Deformed Condition of the Underground Steel Pipeline" CJSC Scientific Production Center, Moscow, 2012. (16 pages).

Office Action issued in related RU Application No. 2015134588, dated Mar. 30, 2017 (7 pages).

Office Action issued in related CN Application No. 201380072887.9, dated Nov. 2, 2017 (6 pages).

* cited by examiner

SYSTEMS AND METHODS FOR OPTIMIZING GRADIENT MEASUREMENTS IN RANGING OPERATIONS

CROSS-REFERENCE TO RELATED APPLICATION

The present application is a U.S. National Stage Application of International Application No. PCT/US2013/032813 filed Mar. 18, 2013, which is incorporated herein by reference in its entirety for all purposes.

BACKGROUND

The present disclosure relates generally to well drilling operations and, more particularly, to systems and methods for optimizing gradient measurements in ranging operations.

In certain instances, such as in a blowout, it may be necessary to intersect a first well, called a target well, with a second well, called a relief well. The second well may be drilled for the purpose of intersecting the target well, for example, to relieve pressure from the blowout well. Contacting the target well with the relief well typically requires multiple downhole measurements to identify the precise location of the target well. One such measurement is a gradient measurement that identifies changes in an electromagnetic field within the formation. The accuracy of the gradient measurements may depend on the distance between sensors measuring the electromagnetic field gradient. Unfortunately, most downhole drilling assemblies and operations provide little flexibility regarding the space between such sensors for the purpose of determining gradient.

FIGURES

Some specific exemplary embodiments of the disclosure may be understood by referring, in part, to the following description and the accompanying drawings.

Figure 1A:
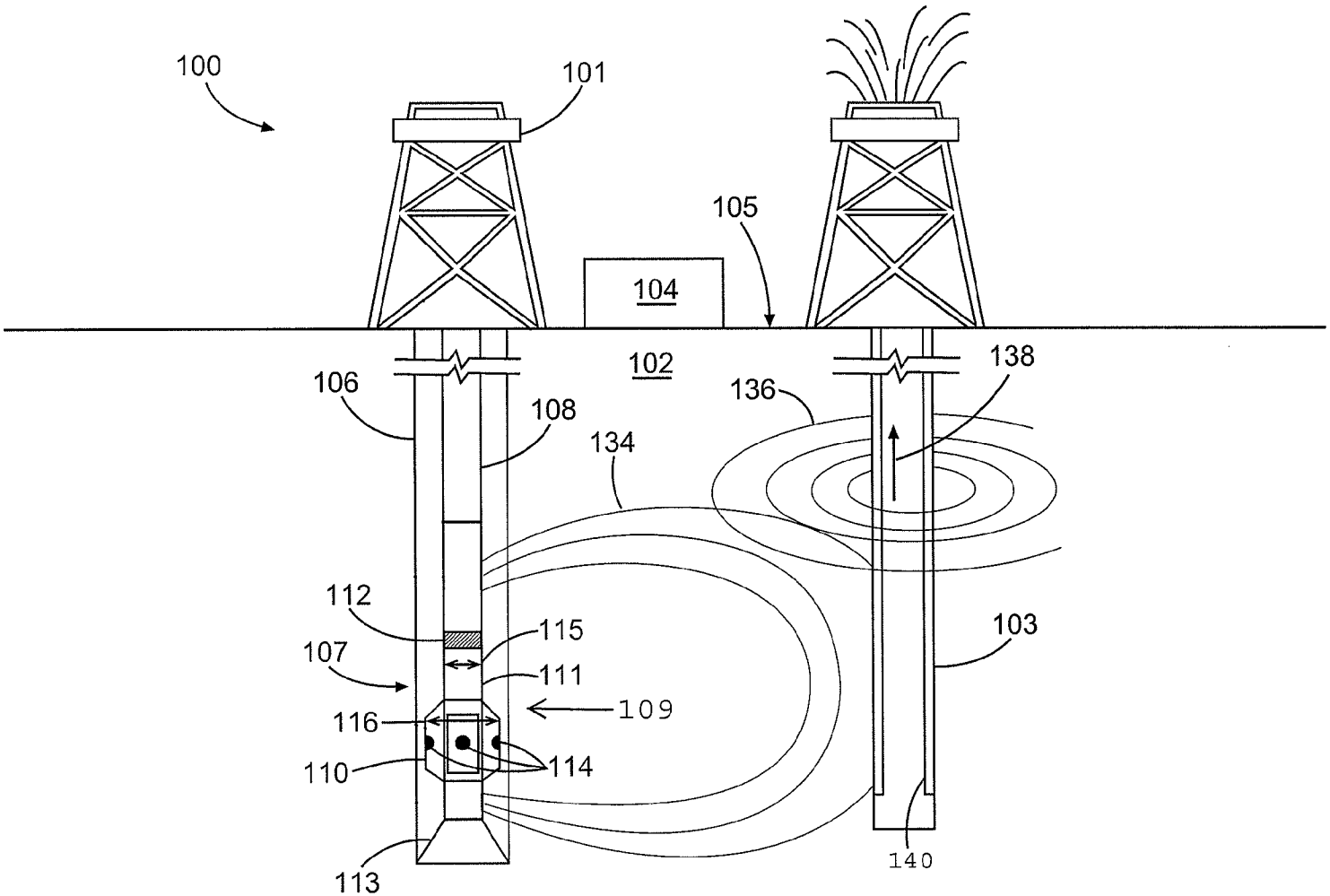
FIGS. 1A and 1B illustrate example drilling systems, according to aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to well drilling operations and, more particularly, to systems and methods for optimizing gradient measurements in ranging operations.

Illustrative embodiments of the present disclosure are described in detail herein. In the interest of clarity, not all features of an actual implementation may be described in this specification. It will of course be appreciated that in the development of any such actual embodiment, numerous implementation-specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the disclosure. Embodiments of the present disclosure may be applicable to drilling operations that include but are not limited to target (such as an adjacent well) following, target intersecting, target locating, well twinning such as in SAGD (steam assist gravity drainage) well structures, drilling relief wells for blowout wells, river crossings, construction tunneling, as well as horizontal, vertical, deviated, multilateral, u-tube connection, intersection, bypass (drill around a mid-depth stuck fish and back into the well below), or otherwise nonlinear wellbores in any type of subterranean formation. Embodiments may be applicable to injection wells, and production wells, including natural resource production wells such as hydrogen sulfide, hydrocarbons or geothermal wells; as well as borehole construction for river crossing tunneling and other such tunneling boreholes for near surface construction purposes or borehole u-tube pipelines used for the transportation of fluids such as hydrocarbons. Embodiments described below with respect to one implementation are not intended to be limiting.

According to aspects of the present disclosure, systems and methods for optimizing gradient measurements in ranging operations are described herein. The system may comprise a drilling apparatus comprising a first portion and a second portion. In certain embodiments, the first portion may comprise a bottom hole assembly (BHA) or a drill string, and the second portion may comprise a sensor extension housing. The first portion may have a first diameter and the second portion may have a second diameter that is greater than the first diameter. In certain embodiments, the second portion may comprise a plurality of blades, and the diameter of the second portion may comprise the diameter of the sensor extension housing at the face of the blades, which may approach the diameter of the borehole.

The system may also include a sensor pair disposed within the second portion and proximate to an outer radial surface of the second portion. The sensor pair may include but is not limited to an induction type sensor, a Hall Effect magnetometer sensor, a magnetic gradiometer or a combination or pair of any of the sensors listed above. The outer radial surface of the second portion may comprise the faces the blades of the sensor extension housing. The sensor pair may be divided between two blades, with each sensor of the sensor pair being disposed in a recessed portion and proximate to the face of a separate blade. In certain embodiments, the separate blades may be diametrically opposite with respect to the longitudinal axis of the second portion, maximizing the radial distance between the sensor pair and increasing the accuracy of the gradient measurement, as will be described below.

A processor may be in communication with the drilling apparatus, and in particular the sensor pair. The processor may determine at least one gradient measurement based, at least in part, on outputs of the sensor pair. The accuracy and/or sensitivity may be increased by increasing the distance between the individual sensors of the sensor pair within the sensor extension housing in order to measure the maximum difference in the superimposed EM field over the earth's magnetic field. For example, the distance between the sensors in an x/y plane may be increased by positioning the sensors in a sensor extension housing with blades that generally approaches or is equal to the diameter of the borehole, while still allowing for junk slot space to permit cuttings and drilling mud to travel upwards in the annulus while drilling. In certain embodiments, it may be advantageous not to have the blades of the sensor extension housing contact the bore wall during drilling, as it may interfere with the steering objectives of the reference borehole.

FIG. 1A shows an example drilling system 100, according to aspects of the present disclosure. The drilling system 100 includes rig 101 at the surface 105 and positioned above borehole 106 within a subterranean formation 102. Rig 101 may be coupled to a drilling assembly 107, comprising drill string 108 and bottom hole assembly (BHA) 109. The BHA 109 may comprise a drill bit 113, an MWD apparatus 111, and a sensor extension housing 110. The sensor extension housing 110 may comprise at least one sensor pair 114. As described above, the at least one sensor pair 114 may include but is not limited to an induction type sensor, a Hall effect magnetometer sensor, a magnetic gradiometer or a combination or pair of any of the magnetometers listed above. In certain embodiments, the sensor extension housing 110 may be positioned at various locations within the BHA 109, or above the BHA 109, such as between the drill string 108 and the BHA 109. It may be advantageous to position the sensor extension housing 110 as close to the bottom of the hole as possible. For example, in certain embodiments, the at least one sensor pair 114 may be placed in the drill bit 113 rather than in a BHA sub somewhere above the drill bit 113.

The sensor extension housing 110 may comprise an outer radial surface. In the embodiment shown, the outer radial surface is defined by a plurality of blades, with the plurality of blades comprising two diametrically opposite pairs of blades. The outer radial surface may be defined by the blades and may establish a diameter 116 of the sensor extension housing 110. In the embodiment shown, the diameter 116 of the sensor extension housing 110 may be characterized as the distance between the outer faces of a pair of diametrically opposite blades with respect to a longitudinal axis of the sensor extension housing 110. Notably, the diameter 116 of the sensor extension housing 110 may approach the diameter of the borehole 106.

In certain embodiments, the drill string 108 or BHA 109 may comprise a first portion of the drilling apparatus 107, and the sensor extension housing 110 may comprise a second portion of the drilling apparatus 107. The first portion may have a first diameter 115, and the second portion may have a second diameter 116 that is greater than the first diameter 115. As can be seen, the first diameter 115 may comprise the diameter of the drill string 108 or BHA 119. The first diameter 115 may be constant or vary if different types of MWD tools are used in the BHA 109. That said, the various diameters of the first portion may be less than the diameter 116 of the sensor extension housing 110.

Ranging measurements may require that a location of borehole 103 be identified. The borehole 103 may comprise a target well containing or composed of an electrically conductive member such as casing, liner or a drill string or any portion thereof that has had a blowout or that needs to be intersected, followed or avoided. In the embodiment shown, the borehole 103 includes an electrically conductive casing 140. Identifying the location of the target well 103 may comprise taking various measurements. These measurement may include measurements of imposed current flowing on the target well 103 by excitation methods such as wireline electrodes, BHA based electrodes, or excitation of the target well casing 150 directly. These measurements may comprise various measurements of electromagnetic fields in the formation, such the gradient in the electromagnetic field. Gradient measurements or absolute magnetic field measurements may identify the distance and direction to the target well 103, which is useful for determining the location of the target well 103.

Drilling assembly 107 may include a gap sub 112 that may allows for the creation of a dipole electric field to be created across the gap to aid in flowing current off of the drill string and into the formation 102. In the embodiment shown, a time-varying current 134 may be induced within the formation 102 by energizing the portion of the drilling assembly 107 above the gap sub 112. Due to the higher conductivity of the casing 140 in the target well 103 that the surrounding formation 103, part of the induced current 134 may be concentrated at the casing 140 within the target well 103, and the current 138 on the casing 140 may induce an electromagnetic field (EM) 136 field in radial direction from the direction of the flow of the electric current 138. The remaining induced current 134 may be received at the portion of the drilling assembly 107 below the gap sub 112. The use of a time-varying current 134 may be useful to aid in detection of the induced EM field 136 by allowing the EM field 136 to be detected above the background magnetic field of the earth. The time-varying current 134 may take a variety of forms, including sinusoidal, square wave, saw wave, etc.

According to aspects of the present disclosure, the at least one sensor pair 114 may be disposed within sensor extension housing 110 and proximate to the outer radial surface of the sensor extension housing 110. Notably, a sensor pair for gradient measurements may be aligned in a flat plane, with the accuracy of the gradient measurement depending on the distance between the sensors in the plane. The sensor pair 114 may take independent measurements of the EM field 136, which can be used together to determine a gradient value of the EM field 116, as will be described below. Advantageously, positioning the sensor pairs 114 in the blades of sensor extension housing 110 may allow for an increase in the distance between the sensor pair in an x/y plane that is perpendicular to the longitudinal axis of the sensor extension housing 110, which may increase the accuracy of the gradient value. Thus, as can be seen, the distance between the sensor pairs 114 may be maximized to the extent allowed within the borehole 106.

In certain embodiments, the drilling assembly 107, including sensor pairs 114 and other measurement equipment, may be in communication with a control unit 104 positioned at the surface 105. The control unit 104 may comprise a processor and a memory device coupled to the process that may cause the processor to control the operation of the drilling assembly 107, receive outputs from the sensor pairs 114 and other measurement equipment, and determine certain measurement values, such as a gradient value, based at least in part on the output of the sensor pairs 114 and other measurement equipment. Although the control unit 104 is positioned at the surface, certain processing, memory, and control elements may be positioned within the drilling assembly 107.

In certain embodiments, the sensor pairs 114 may be in communication with a steering control system, which may incorporate all or elements of control unit 104. For example, a steering control system may comprise an automatic steering control system located either within the drilling assembly 107 or at the surface 104. The steering control assembly may receive measurements from the sensor pairs 114, determine a gradient value, and then automatically adjust the drilling direction of the drilling assembly to intersect, follow, or avoid the target well 103, depending on the operational requirements. In other embodiments, the steering control system may be at least partially controlled by a worker positioned at the surface. In such instances, the sensor pairs 114 may still communicate with a control unit 104 at the surface, which may determine a gradient value of the EM field 136, but the drilling direction may be manually controlled.

Figure 1B:
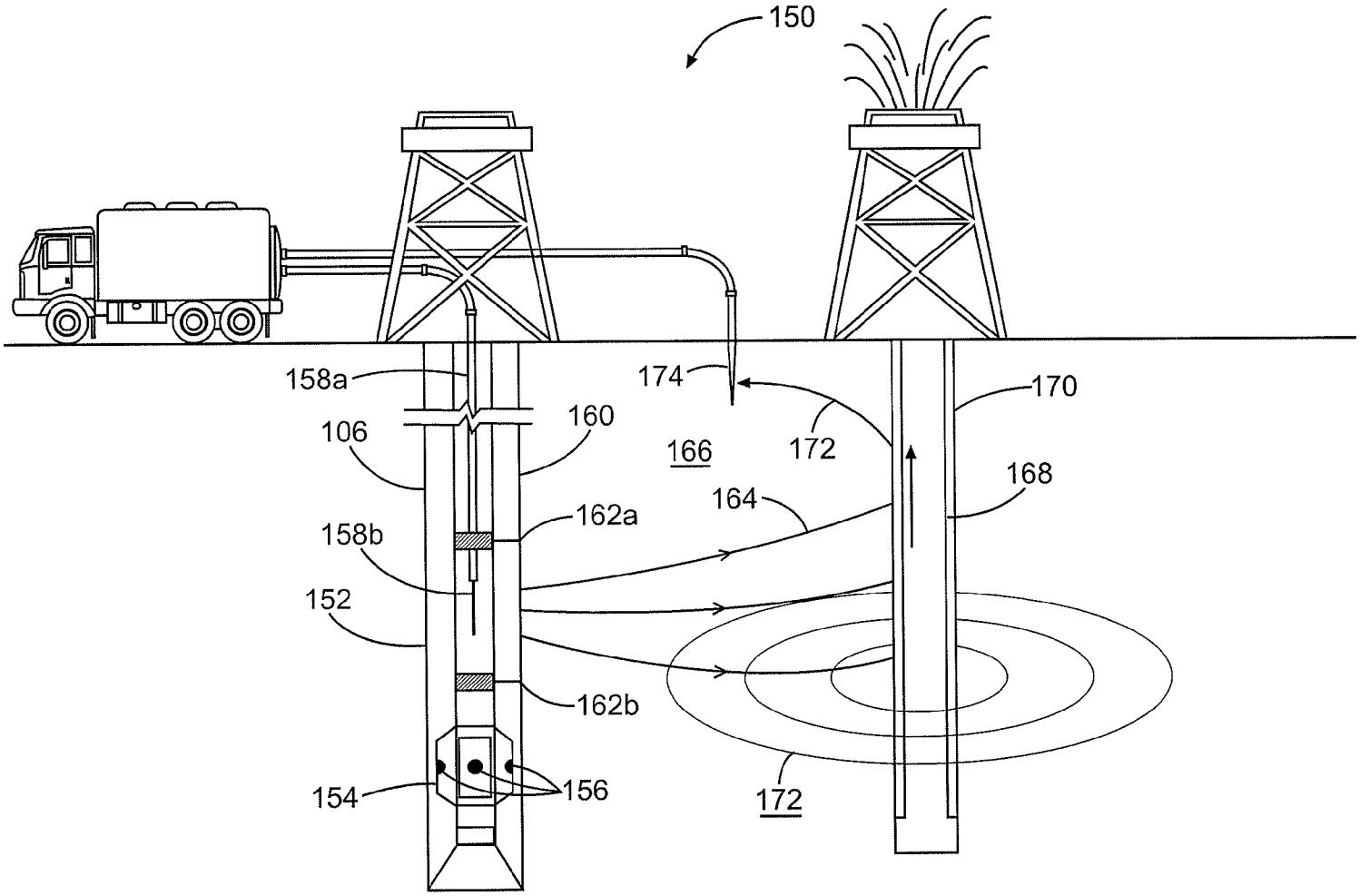

FIG. 1B shows an example drilling system 150, according to aspects of the present disclosure. As will be appreciated by one of ordinary skill in view of this disclosure, FIG. 1B illustrates a drilling system 150 using a sensor extension housing 154 and at least one sensor pair 156, similar to the corresponding elements in FIG. 1A. The drilling system 150 comprises a different excitation scheme, however, that is equally applicable to the sensor extension housings described herein. As can be seen, the excitation scheme may comprise a wireline 158 disposed in a borehole 160. The wireline may comprise an insulated portion 158*a* and an uninsulated portion 158*b*. The uninsulated portion 158*b* may be positioned between two gap subs 162*a* and 162*b* within the drilling assembly 152. Time-varying current 164 may be injected by the wireline 158 into the formation 166, where it is received on the casing 168 within target well 170. The current on the casing 168 may induce an EM field 172 in the formation, whose gradient may be measured with the sensor pairs 156 in the sensor extension housing 154. The current 172 may be returned using an electrode 174 positioned at the surface.

Figure 2:
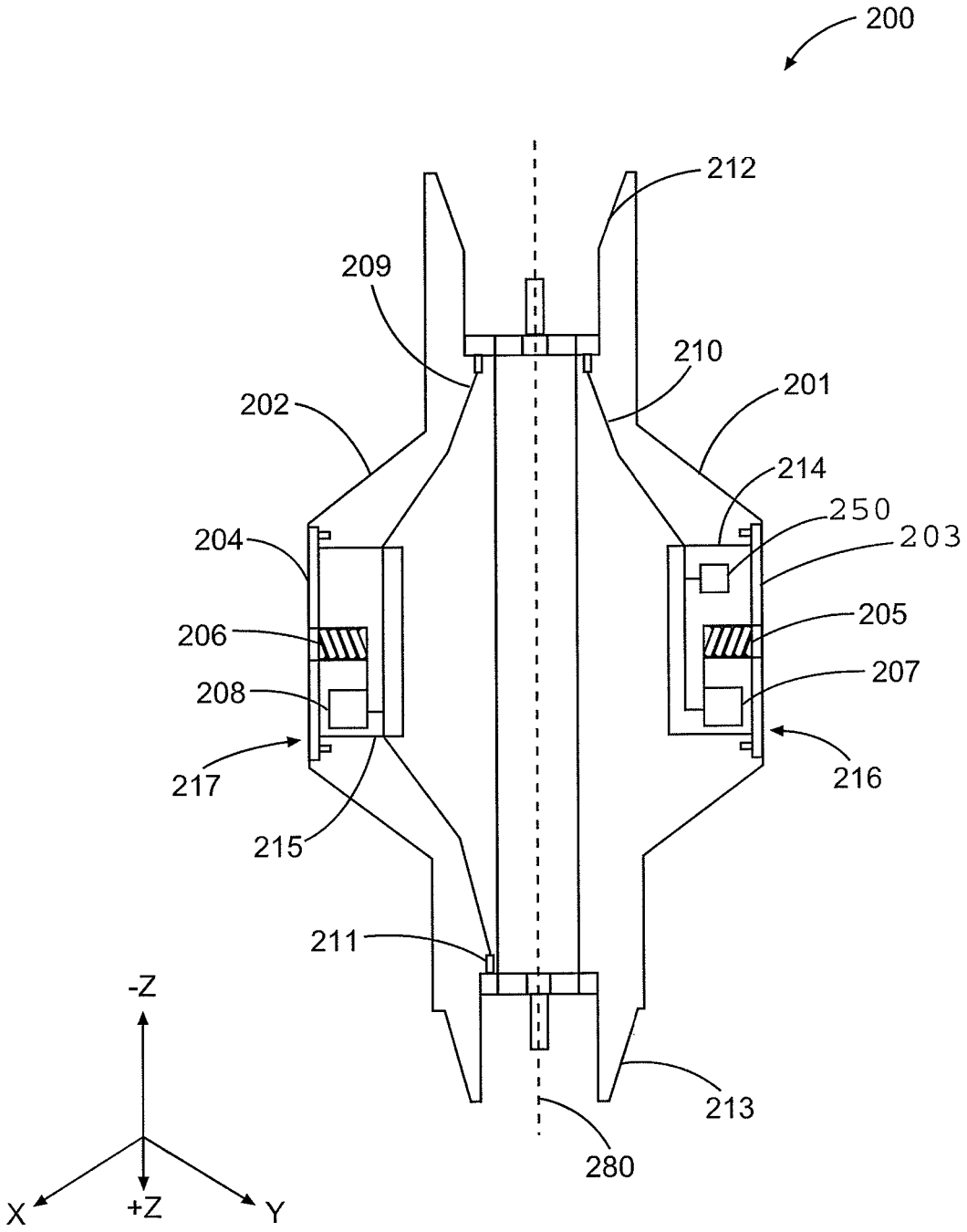
FIG. 2 illustrates an example sensor extension housing, according to aspects of the present disclosure.

FIG. 2 illustrates an example second portion of a drilling assembly, sensor extension housing 200. The sensor extension housing 200 may be coupled to a first portion, such as drill string segments or a BHA, via threaded connections 212 and 213. The sensor extension housing 200 may further be incorporated into a BHA using the threaded connections. The sensor extension housing 200 may comprise a plurality of blades, including blades 201 and 202. As can be seen, blades 201 and 202 may be diametrically opposite relative to the longitudinal axis 280 of the sensor extension housing 200. A sensor pair including sensors 205 and 206 may be at least partially disposed within the blades 201 and 202, respectively, proximate to outer radial surfaces of the sensor extension housing 200. As can be seen, the outer radial surfaces of the sensor extension housing may comprise faces 216 and 217 of blades 201 and 202. An outer radial surface of the sensor extension housing 200 may refer collectively to the faces of all of the blades of the sensor extension housing 200, or may refer to separate faces of particular blades individually.

In certain embodiment, the plurality of blades may be concentric in diameter, and the radial position of the sensors may be identical to aid in calibration of the system. However, the actual offset from the longitudinal axis of any sensor pair does not have to be equal so long as the separation is accounted for, as will be described below. Accordingly, in certain embodiments, the shape of the sensor extension housing can be eccentric in nature such as the blades on an eccentric drill bit.

The sensor pair 205 and 206 may be at least partially disposed within recessed areas 214 and 215 of the respective blades. Additionally, circuit boards 207 and 208 may also be disposed within the recessed areas 214 and 215, and may provide power to and a communication pathway to/from sensor pair 205 and 206 via wires 209, 210, and 211. Faces 216 and 217 may comprise detachable covers 203 and 204, respectively, which may at least partially cover recessed areas 214 and 215. The sensor pair 205 and 206 may comprise induction type sensors with a ferromagnetic core such as mu-metal (laminated sheets or solid), iron (laminated sheets or solid), or a ferrite core, all of which may be wound with wire. In other embodiments, the sensors may comprise Hall Effect sensors or forms of magnetometers. Sensor pair 205 and 206 may at least partially protrude through the detachable covers 203 and 204, exposing the cores to the surrounding EM field.

To aid in the measurement of the orientation of the sensors 205 and 206 relative to the down direction, a gravity sensor such as an accelerometer 250 may be included in the sensor package so that the orientation of the sensors 205 and 206 relative to the down direction can be determined and referenced back to the reference well geometry through the use of well-known survey calculation such as inclination and high side reference of the hole. Gravity sensor arrangements can have several variations such as 2 orthogonal cross axis accelerometers or 3 orthogonal accelerometers with X and Y being the cross axis directions and the Z axis along the tool long axis in the hole.

To further increase the amount of magnetic flux received at the sensors 205 and 206, the detachable covers 203 and 204 may be at least partially composed of a high magnetic-permeability material, such as a steel-alloy, mu metal, etc. This material may allow the magnetic flux to be drawn in through the detachable covers 203 and 204 and collected at the sensors 205 and 206. In certain embodiments, the detachable covers 203 and 204 may be totally composed of high magnetic-permeability material, such as a steel alloy or a mu metal. In the case where the sense axis is aligned parallel to the faces of the detachable covers 203 and 204, the blades may be fitted with highly magnetically permeable material such as steel, to aid in magnetic flux collection along this direction. In certain other embodiments, such as when the sensors 205 and 206 comprise magnetometers, the entire sensor extension housing 200 may be made of the a non-magnetic alloy such as monel or Austenic stainless steel, having a very low magnetic relative permeability of 1.02 or less, to avoid shielding of the magnetic field emanating from the target excitation current.

Figure 3:
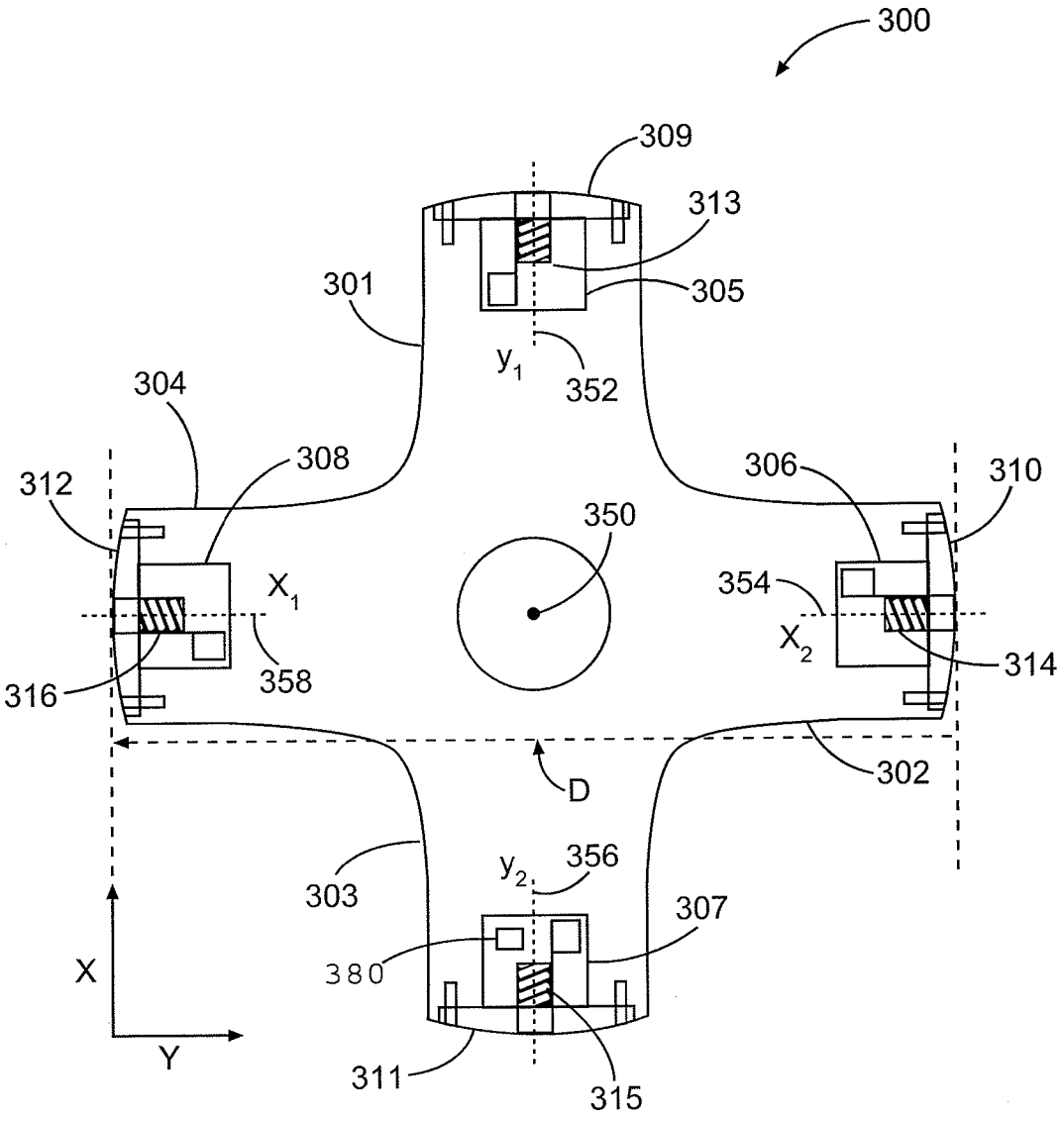
FIG. 3 illustrates an example sensor extension housing, according to aspects of the present disclosure.

FIG. 3 illustrates a cross section of a sensor extension housing 300 with a similar configuration to sensor extension housing 200. As can be seen, the sensor extension housing 300 comprises four blades 301-304. Although the sensor extension housing 300 has four blades, other configurations are possible, including, but not limited to, different numbers of blades and blade with different configurations, such as spiraled. As can be seen, each of the blades 301-304 may have corresponding sensors 313-316 disposed in recessed areas 305-308 that are at least partially covered by detachable covers 309-312. At least one of the blades may include an accelerometer 380. The sensors pairs may comprise sensors 314 and 316 and sensors 313 and 315, which are diametrically opposite to increase the distance between them. The sensor extension housing 300 may have a diameter D, which may be characterized by the distance between outer radial surfaces of diametrically opposite blades 302 and 304. Additionally, each one of the EM field sensors 313-316 may have a respective longitudinal axis 352-358. In the embodiment shown, the longitudinal axes 352-358 may be perpendicular to the longitudinal axis 350 of sensor extension housing 300.

As can be seen, in FIG. 2 and FIG. 3, the sensor pairs may be arranged in a flat x/y plane that is perpendicular to the longitudinal axis 350 of the sensor extension housing 300. As described above, the accuracy of the gradient measurement may be affected by the distance between two sensors in a sensor pair, including the distance between sensors 313 and 315, and the distance between sensors 314 and 316. While sensor pairs may be arranged in the same cross axis plane, as in FIG. 3, some axial separation is possible. Typically, however, as one gets closer to the target well, the axial displacement of a sensor pair can present problems with the gradient measurement if the angle of approach to the target well is not near enough.

According to aspects of the present disclosure, the distance between two sensors in a sensor pair in the x/y plane may be increased to the limits of a corresponding borehole, thereby maximizing the gradient accuracy. For example, in FIG. 3, because the sensor pair 313 and 315 is positioned proximate to an outer radial surface of the sensor extension housing 300, within blades 301 and 303, the distance between two sensors in the sensor pair along the x-axis is maximized. Likewise, because the sensor pair 314 and 316 is positioned proximate to an outer radial surface of the sensor extension housing 300, within blades 302 and 304, the distance between the two sensors in the sensor pair along the y-axis is maximized.

Figure 4:
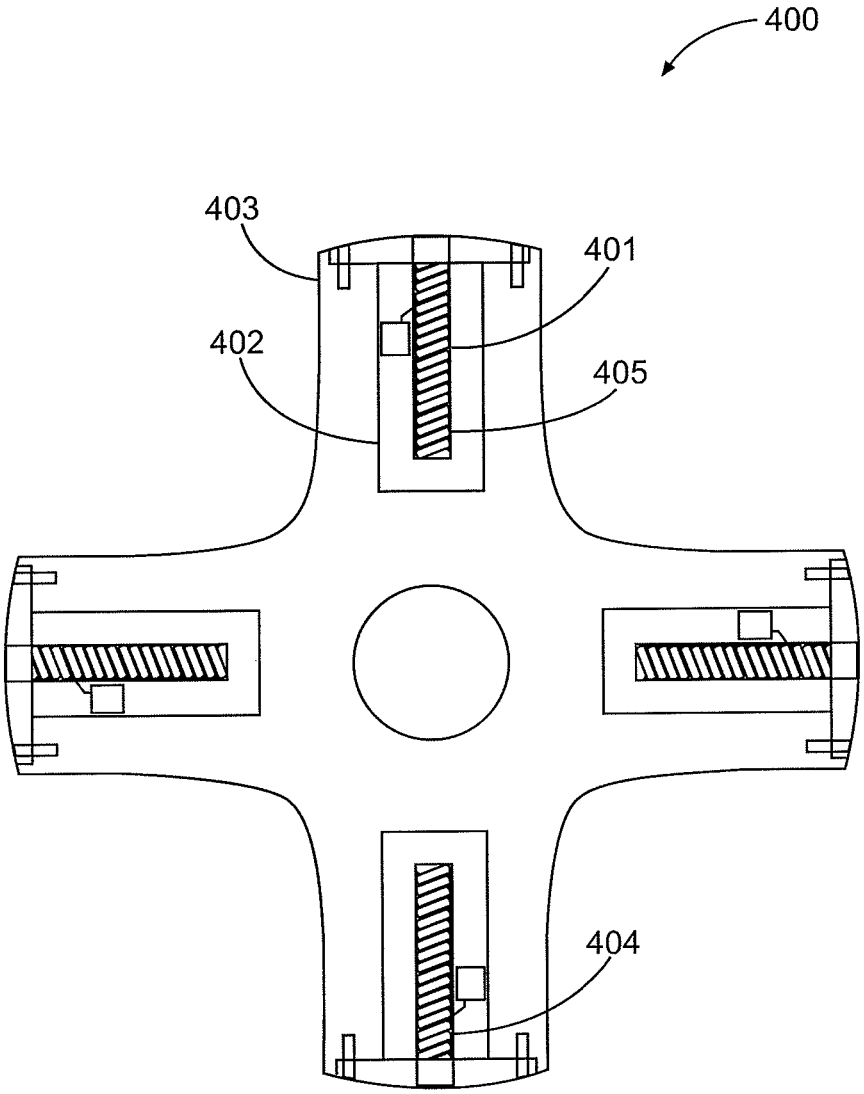
FIG. 4 illustrates an example sensor extension housing, according to aspects of the present disclosure.
Figure 5:
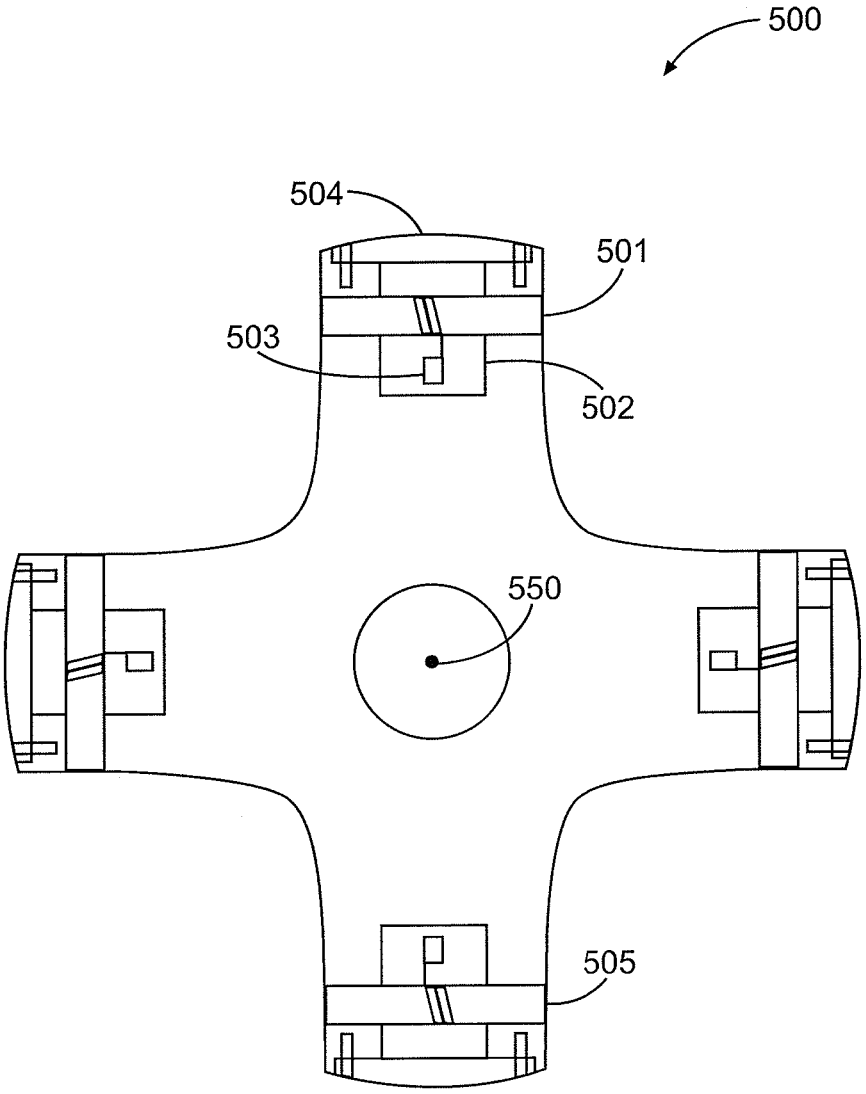
FIG. 5 illustrates an example sensor extension housing, according to aspects of the present disclosure.

FIGS. 4 and 5 show example four-sensor extension housings with additional configurations of induction type sensors, according to aspects of the present disclosure. As can be seen in FIG. 4, sensor extension housing 400 may include a four-blade configuration similar to the sensor extension housings described above. As can be seen, the sensor extension housing may comprise at least one sensor pair 401 and 404. The sensor 401 may be disposed within a recessed portion 402 of blade 403. In the embodiment shown, the core 405 of the induction sensor 401 has been elongated, which may increase the amount of the magnetic flux collected by the sensor. Notably, core of the sensor 401 may be extended along the same axis as the mated sensor 404 on the diametrically opposite side of the sensor extension housing 400. In FIG. 5, the orientation of the sensors have been changed relative to the longitudinal axis 550 of the sensor extension housing 500. For example, an induction type sensor 501 may be turned 90° relative to the configuration in FIG. 4, such that the longitudinal axis of the sensor 501 does not intersect with the longitudinal axis 550 of the sensor extension housing 500. Notably, the sensor 501 may still be at least partially disposed within a recessed portion 502 of blade 504, such that it is proximate to the outer surface of the blade 504. Additionally, the sensor 501 may still form a sensor pair with sensor 505, and may include an electronics package 503.

Figure 6A:
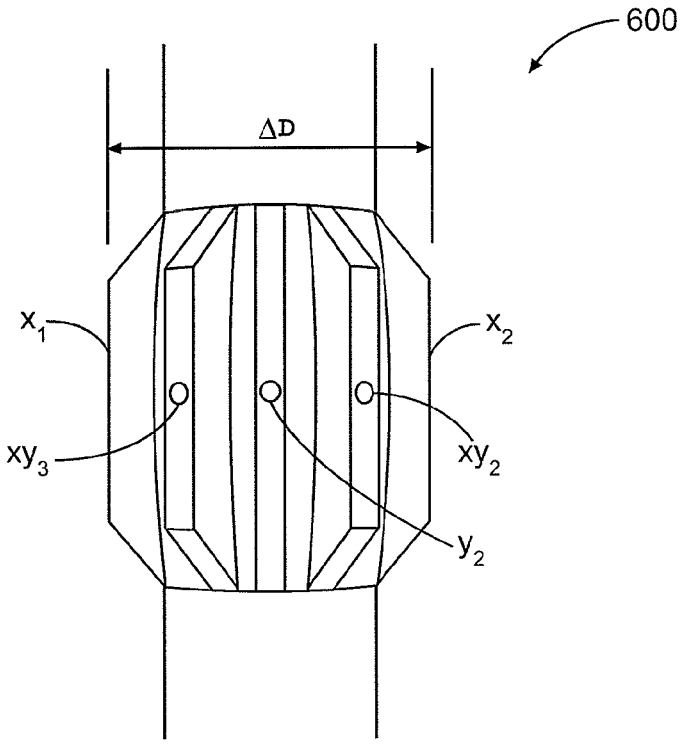
FIGS. 6A and 6B illustrate an example sensor extension housing, according to aspects of the present disclosure.
Figure 6B:
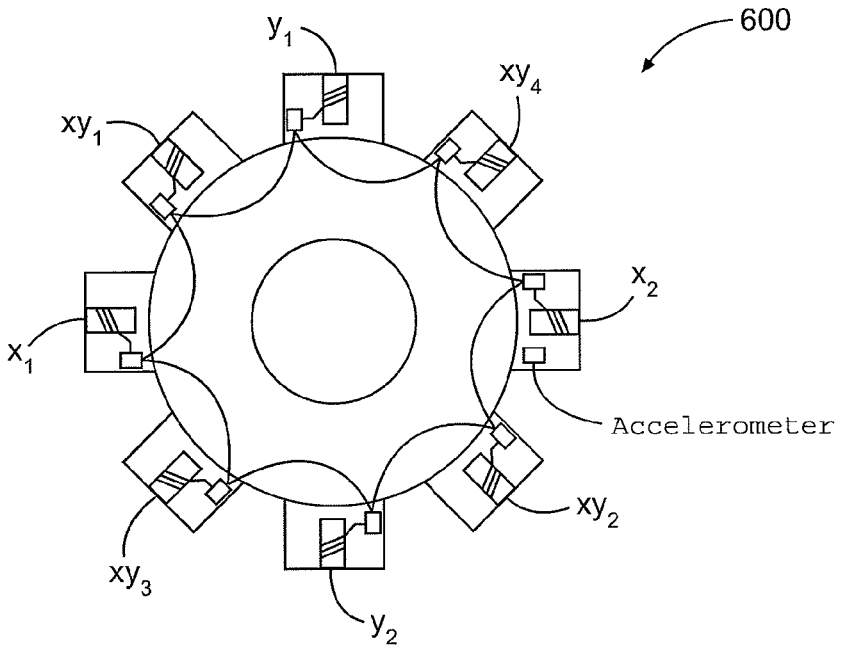

FIGS. 6A and 6B illustrate another example embodiment of sensor extension housing 600. As can be seen, the sensor extension housing 600 may comprise an outer radial surface that is defined by a plurality of blades. As can be seen, the outer radial surface comprises a diameter ΔD, which comprises the distance between the outer faces to two diametrically opposite blades, and is equally applicable to each pair of diametrically opposite blades. At least one sensor pair may be positioned within the sensor extension housing 600. In the embodiment shown, the sensor extension housing 600 comprises eight separate sensors x1, x2, y1, y2, xy1, xy2, xy3, and xy4, positioned one in each of the eight blades, creating four sensor pairs. The sensor pairs may comprise x1 and x2, y1 and y2, xy1 and xy2, and xy3 and xy4. As can be seen, the distance between each of the sensor pairs may be ΔD, given their positioning on diametrically opposite blades. Notably, the gradient measurements at each sensor pair may be determined at follows:

$$x1 \text{ and } x2=(H_{x1}-H_{x2})/\Delta D;$$

$$y1 \text{ and } y2=(H_{y1}-H_{y2})/\Delta D;$$

$$xy1 \text{ and } xy2=(H_{xy1}-H_{xy2})/\Delta D;$$

$$xy3 \text{ and } xy4=(H_{xy3}-H_{xy4})/\Delta D.$$

Notably, the final gradient measurement may comprise some averaging calculation of the individual gradient values. As will be appreciated by one of ordinary skill in view of this disclosure, the formulae described above are equally applicable when the distances between the various sensor pairs are not all equal. Specifically, provided the distance between two sensors in a sensor pair are known, the ΔD can be changed to determine the corresponding gradient value.

In certain embodiments, a control unit or computing element may be coupled to the sensor pairs, and may contain a processor and a memory device. The memory device may contain a set of instruction that when executed by the memory device cause the processor to receive measurements from each of the sensor pair, and determine a gradient value. The instruction may cause the processor to process the measurements using the equations above, or equations similar to those above. In certain embodiments, the memory device may include stored data, such as the distance between the sensors of each sensor pair, that can be used to determine gradient measurements. The gradient measurements may identify the location of a target within a formation. In certain embodiments, the control unit or computing unit may transmit the gradient measurement to steering control assembly, which may automatically adjust a drilling direction of a drilling assembly to intersect, follow, or avoid the target.

Figure 7:
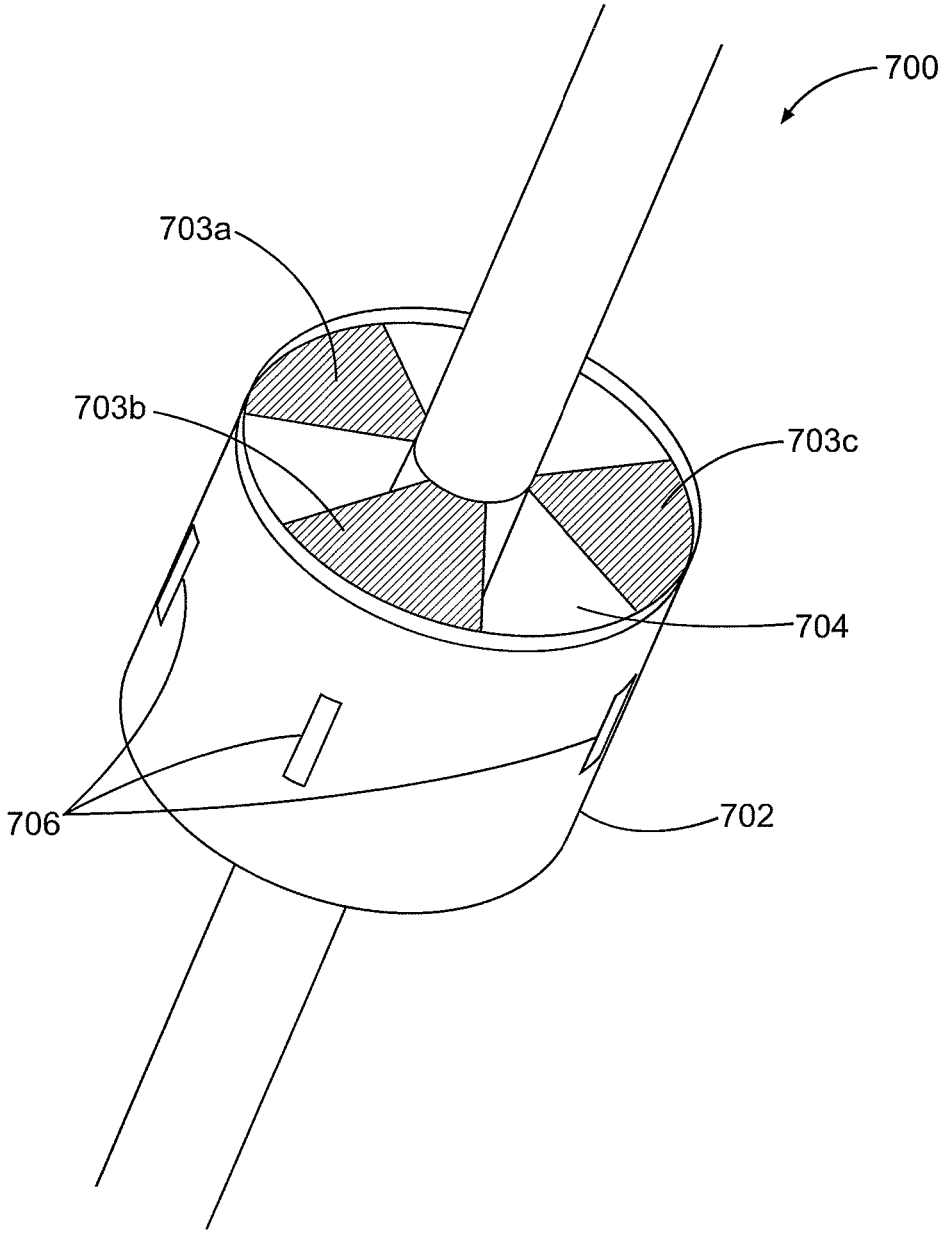
FIG. 7 illustrates an example sensor extension housing, according to aspects of the present disclosure.

FIG. 7 illustrates an another sensor extension housing 700, according to aspects of the present disclosure. As can be seen the sensor extension housing 700 may have an outer radial surface 702 that is defined by a ring surface rather than the exterior surface of blades. As can be seen, the sensor extension housing 700 may comprise a plurality of wedges 703*a-d* (703*d* not shown) within the outer radial surface in which the sensors 706 may be disposed. The sensor extension housing 700 may also comprise at least one sensor pair, and still provide junk slots 704 through which upward flowing drilling fluid may pass.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces.

What is claimed is:

1. A system for optimizing gradient measurements in ranging operations, comprising:

a drilling assembly comprising a drill string and a second portion, wherein the drill string has a first diameter and the second portion has a second diameter that is greater than the first diameter;

a sensor pair disposed within the second portion and proximate to an outer radial surface of the second portion;

a processor in communication with the drilling apparatus, wherein the processor determines at least one electromagnetic field gradient measurement based, at least in part, on outputs of the sensor pair; and wherein the second portion comprises a sensor extension housing that extends to increase a distance between individual sensors of the sensor pair.

2. The system of claim 1, wherein the sensor extension housing comprises a first blade and a second blade.

3. The system of claim 2, wherein a first sensor of the sensor pair is disposed within the first blade and a second sensor of the sensor pair is disposed within the second blade.

4. The system of claim 3, wherein a face of the first blade comprises a detachable cover.

5. The system of claim 4, wherein the detachable cover is at least partially composed of a mu metal that allows a magnetic flux to be drawn in through the detachable cover and collected at the sensor pair.

6. The system of claim 3, wherein the first blade and the second blade are diametrically opposite relative to a longitudinal axis of the sensor extension housing.

7. The system of claim 1, wherein the sensor pair comprises a combination of an induction-type sensor, a Hall effect magnetometer sensor, and a magnetic gradiometer.

8. A method for optimizing gradient measurements in ranging operations, comprising:

disposing a drilling apparatus within a borehole, wherein:

the drilling apparatus comprises a drill string and a second portion, and the drill string has a first diameter, and the second portion has a second diameter that is greater than the first diameter;

receiving at least one output from a sensor pair disposed within the second portion of the drilling apparatus and proximate to an outer radial surface of the second portion;

determining an electromagnetic field gradient measurement at a processor in communication with the drilling apparatus, wherein the electromagnetic field gradient measurement is based, at least in part, on the at least one output from the sensor pair;

determining a location of a target well based, at least in part, on the electromagnetic field gradient measurement;

adjusting a drilling operation based, at least in part, on the determined location of the target well; and increasing sensitivity of the sensor pair by increasing a distance between individual sensors within a sensor extension housing of the second portion.

9. The method of claim 8, wherein the sensor extension housing comprises a first blade and a second blade.

10. The method of claim 9, wherein a first sensor of the sensor pair is disposed within the first blade and a second sensor of the sensor pair is disposed within the second blade.

11. The method of claim 10, wherein the face of the first comprises a detachable cover.

12. The method of claim 11, wherein the detachable cover is at least partially composed of a mu-metal that allows a magnetic flux to be drawn in through the detachable cover and collected at the sensor pair.

13. The method of claim 10, wherein the first blade and the second blade are diametrically opposite relative to a longitudinal axis of the sensor extension housing.

14. The method of claim 10, wherein the sensor pair comprises a combination of an induction-type sensor, a Hall effect magnetometer sensor, and a magnetic gradiometer.

15. The method of claim 14, wherein the second portion is composed of a non-magnetic steel alloy.

16. A drilling apparatus for using in ranging operations, comprising:

a drill string;

a sensor extension housing coupled to the drill string, wherein the sensor extension housing comprises a plurality of blades;

a plurality of sensors arranged in sensor pairs, wherein each blade includes one sensor disposed therein, proximate to an outer radial face of the blade; and a processor in communication with the plurality of sensors, wherein the processor determines at least one electromagnetic field gradient measurement based, at least in part, on outputs from the sensor pairs; and a sensor extension housing that extends to increase a distance between individual sensors of the sensor pairs.

17. The drilling apparatus of claim 16, wherein each of the plurality of blades has a corresponding blade that is diametrically opposite with respect to a longitudinal axis of the sensor extension housing.

18. The drilling apparatus of claim 16, wherein each sensor pair comprises a combination of an induction-type sensor, a Hall effect magnetometer sensor, and a magnetic gradiometer.

* * * * *